US005256622A

United States Patent [19]

Henzel

[11] Patent Number: 5,256,622

[45] Date of Patent: Oct. 26, 1993

[54] HIGH VISCOSITY BINDERS FOR THERMAL DYE TRANSFER DYE-DONORS

[75] Inventor: Richard P. Henzel, Webster, N.Y.

[73] Assignee: Eastman Kodak Company, Rochester, N.Y.

[21] Appl. No.: 781,058

[22] Filed: Oct. 18, 1991

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,700,207 10/1987 Vanier et al. ..... 503/227

*Primary Examiner*—B. Hamilton Hess

*Attorney, Agent, or Firm*—Harold E. Cole

[57] ABSTRACT

A dye-donor element for thermal dye transfer comprising a support having thereon a dye layer comprising a dye dispersed in a polymeric binder and wherein the polymeric binder has an intrinsic viscosity of at least 1.6.

20 Claims, No Drawings

HIGH VISCOSITY BINDERS FOR THERMAL DYE TRANSFER DYE-DONORS

This invention relates to use of high viscosity binders for thermal dye transfer dye donors.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sep. 23, 1985, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

When coating a dye-donor element, it is important that the coating be as uniform as possible to minimize defects in the final print. The dye and binder are usually dissolved in an organic solvent for coating. When a coating containing an organic solvent is dried, air impingement on the coating can result in coating nonuniformities, known as mottle. One way to improve the uniformity of the coating is to use more binder which will increase the solution coating viscosity. However, in a dye-donor element used for thermal dye transfer, this is not desirable since increasing the binder will decrease the dye-to-binder ratio, which in turn will diminish the efficiency of the coating.

U.S. Pat. No. 4,700,207 relates to cellulosic binders for thermal dye-donor elements. There is a problem with these binders in that when they are coated, coating nonuniformities result as described above. This will be shown in the comparative examples below.

It is an object of this invention to improve the coating uniformity of a dye-donor used for thermal dye transfer without increasing the amount of the binder used in the coating.

These and other objects are achieved in accordance with the invention which comprises a dye-donor element for thermal dye transfer comprising a support having thereon a dye layer comprising a dye dispersed in a polymeric binder, and wherein the polymeric binder has an intrinsic viscosity of at least 1.6.

It has been found that when the intrinsic viscosity is at least 1.6, then the coating can be dried with minimal coating nonuniformities. The intrinsic viscosity is an inherent specified value for a given polymer, and is related to the solution coating viscosity which depends on concentration and the solvent used.

Any polymeric material may be used in the invention as long as it has the intrinsic viscosity as noted above. For example, there may be used cellulosic derivatives, e.g., cellulose acetate hydrogen phthalate, cellulose acetate, cellulose acetate propionate, cellulose acetate butyrate, cellulose triacetate, a hydroxypropyl cellulose ether, an ethyl cellulose ether, etc, polycarbonates; polyvinyl acetate, poly(styrene-co-acrylonitrile), a poly(sulfone); a poly(phenylene oxide); a polyethylene oxide; a poly(vinyl alcohol-co-acetal) such as poly(vinyl acetal), poly(vinyl alcohol co-butyral) or poly(vinyl benzal); or mixtures thereof. The binder may be used at a coverage of from about 0.1 to about 5 $g/m^2$.

In a preferred embodiment, cellulose esters are employed which are made by the process described in copending U.S. Ser. No. 495,186 of Charles Buchanan, filed Mar. 19, 1990, the disclosure of which is hereby incorporated by reference. In general, U.S. Ser. No. 495,186 describes two processes for preparing cellulose esters having the intrinsic viscosity noted above. One of the processes is referred to as the "triesterification process". In that process, a cellulose polymer having a degree of substitution of less than about 3 is contacted with trifluoroacetic anhydride and an acyl anhydride in the presence of a solvent, followed by a hydrolysis step to form the desired cellulose ester. The second process in that application involves contacting a cellulose polymer with trifluoroacetic anhydride, an acyl anhydride and trifluoroacetic acid in the presence of a solvent to form the desired cellulose ester.

Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

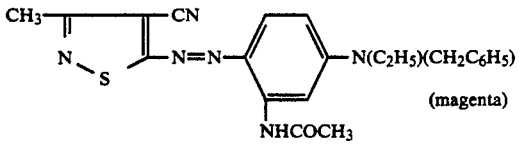
(magenta)

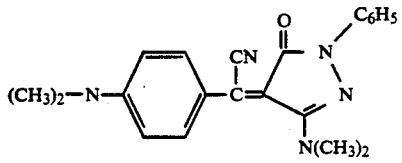
(magenta)

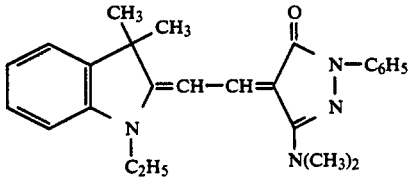
(yellow)

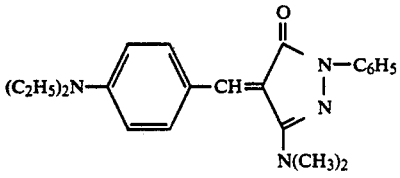
(yellow)

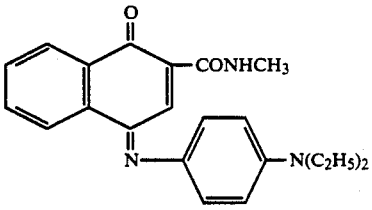
(cyan)

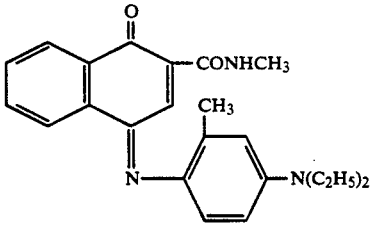
(cyan)

or any of the dyes disclosed in U.S. Pat. No. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed theron by a printing technique such as a gravure process.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as duPont Tyvek ®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have alternating areas of dyes such as sublimable cyan and/or magenta and/or yellow and/or black or other dyes. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and magenta, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552 and 4,912,083 and U.S. application Ser. Nos.: 366,952, 369,493, 369,492, and 369,491, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing material may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989, the disclosure of which is hereby incorporated by reference.

Spacer beads may be employed in a separate layer over the dye layer of the dye-donor in the above-described laser process in order to separate the dye-donor from the dye-receiver during dye transfer, thereby increasing the uniformity and density of the transferred image. That invention is more fully described in U.S. Pat. No. 4,772,582, the disclosure of which is hereby incorporated by reference. Alternatively, the spacer beads may be employed in the receiving layer of the dye-receiver as described in U.S. Pat. No. 4,876,235, the disclosure of which is hereby incorporated by reference. The spacer beads may be coated with a polymeric binder if desired.

The use of an intermediate receiver with subsequent retransfer to a second receiving element may also be employed in the invention. A multitude of different substrates can be used to prepare the color proof (the second receiver) which is preferably the same substrate used for the printing press run. Thus, this one intermediate receiver can be optimized for efficient dye uptake without dye-smearing or crystallization.

Examples of substrates which may be used for the second receiving element (color proof) include the following: Flo Kote Cove® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Ad-Proof Paper® (Appleton Papers, Inc.), Consolith Gloss® (Consolidated Papers Co.) and Mountie Matte® (Potlatch Inc.).

As noted above, after the dye image is obtained on a first dye-receiving element, it is retransferred to a second dye image-receiving element. This can be accomplished, for example, by passing the two receivers between a pair of heated rollers. Other methods of retransferring the dye image could also be used such as using a heated platen, use of pressure and heat, external heating, etc.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Preparation of High Viscosity Cellulose Acetate Propionate

In this example, the materials employed were loaded into a flask equipped for mechanical stirring. The reactor was then heated to 50° to 60° C. The reaction mixture was stirred until a clear solution was obtained which is the indicated reaction time for the triesters. Typically, the reaction mixture was filtered before the products were isolated by the addition of a non-solvent. The results indicate yields of isolated, well-characterized products. The products were typically characterized by proton NMR spectroscopy, intrinsic viscosity, gel permeation chromatography, differential scanning calorimetry, and other methods familiar to those skilled in the art.

The reagents set forth below were subjected to the standard procedure described above under the indicated reaction conditions. The result, in terms of identity and yield of the desired cellulose ester, and key analyses of the product are also set forth below.

| | |
|---|---|
| Starting Cellulosic | Cellulose (Placetate, Lot D) |
| Weight (g) | 250 |
| Equivalents of TFAA*/hydroxyl | 1.37 |
| Acyl Anhydride | Propionic Anhydride |
| Equivalents/hydroxyl | 1.7 |
| Acyl anhydride | Acetic Anhydride |
| Equivalents/hydroxyl | 0.05 |
| Carboxylic Acid | Propionic Acid |
| Weight (g) | 1490 |
| Reactive Hydrolysis Solvent | Water |
| Weight (g) | 420 |
| Contact Time (h) | 23 (Esterification = 8 h; Hydrolysis = 15 h) |
| Product | Cellulose Acetate Propionate, 64% |
| Degree of Substitution (From NMR) | Ac = 0.03, Pr = 2.33 |
| Intrinsic Viscosity (Phenol/TCE) | 1.88 |
| DSC (°C.) | $T_m$ = 182; $t_g$ = 135. |

*trifluoroacetic anhydride

The above procedure forms no part of this invention and is the subject matter of copending U.S. Ser. No. 495,186 of Charles Buchanan, filed Mar. 19, 1990.

EXAMPLE 2

A dye donor element was prepared by coating on a 100 μm thick poly(ethylene terephthalate) support a dye-layer of the magenta dye identified below (0.38 g/m$^2$) and the cyanine infrared absorbing dye identified below (0.054 g/m$^2$) in the binders identified below (0.38 g/m$^2$) from a solvent mixture of 50 wt % dichloromethane, 20 wt % 1,1,2-trichloroethane, 20 wt % toluene and 10 wt % ethanol.

Pyrazolylazoaniline Magenta Image Dye

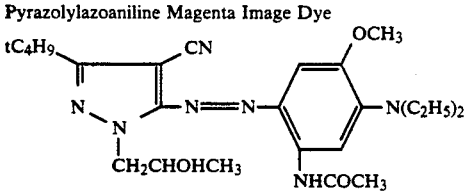

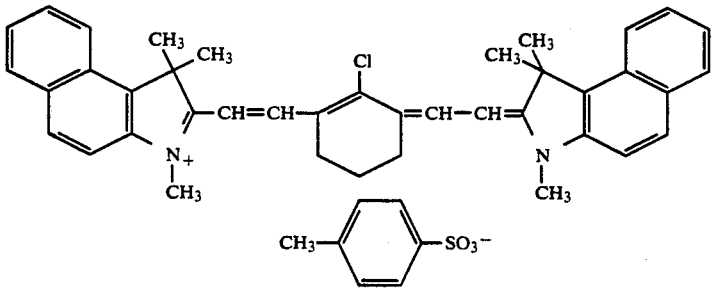

Cyanine Infrared Absorbing Dye

The solution viscosity was measured at 24° C. for each of the above coating preparations (solution of image dye, infrared absorbing dye, and binder) in the solvent mixture using a Brookfield viscometer. This is essentially the solution viscosity of the binder in the solvent as the effect of the two dye components is negligible.

Each intrinsic viscosity was also determined at 25° C. in the same solvent coating mixture using an infinite dilution method as described by E. O. Kraemer, Ind. Eng. Chem, 30, 1200 (1938).

The following invention polymeric binders were evaluated:

1. Cellulose acetate propionate (CAP) (2.5% acetyl, 45% propionyl) with an intrinsic viscosity of 1.8 dL/g (the measured coating solution viscosity was 5.9 cps for this polymer in the above specified coating solvent at 1.6 wt. percent). This material was prepared by Example 1.
2. A hydroxypropyl cellulose (HPC) Klucel G® (Aqualon Co.) with an intrinsic viscosity greater than 4.70 dL/g (the measured coating solution viscosity was 131 cps for this polymer in the above specified coating solvent at 1.6 wt. percent).
3. An ethyl cellulose (EC) K5000 (Aqualon Co.) with an intrinsic viscosity greater than 3.6 dL/g (the measured coating solution viscosity was 1150 cps for this polymer in the above specified coating solvent at 1.16 wt. percent).
4. Ethyl cellulose (EC) HE350H (described as a ethyl ether of cellulose) (Dow Chemical Co.) with an intrinsic viscosity of 3.0. dL/g. This differs from polymer 2 in the substitution on the cellulose backbone (the measured coating solution viscosity was 14.4 cps for this polymer in the above specified coating solvent at 1.16 wt. percent).
5. Ethyl cellulose (EC) HE350 (described as a high ethoxyl ethyl cellulose) (Dow Chemical Co.) with an intrinsic viscosity of 2.9 dL/g (the measured coating solution viscosity was 8.2 cps for this polymer in the above specified coating solvent at 1.16 wt. percent).

The following polymeric binders were evaluated as controls:

C-1 Cellulose acetate propionate (CAP) (identification CAP-482-20) (2.5% maximum acetyl, 45–49% propionyl) (Eastman Chemical Products) with an intrinsic viscosity of 1.4 dL/g) (the measured coating solution viscosity was 3.0 cps for this polymer in the above specified coating solvent at 1.16 wt. percent).

C-2 Cellulose acetate propionate (CAP) (identification CAP-482-0.5) (0.5–2.5 % acetyl, 43–47% propionyl) (Eastman Chemical Products) with an intrinsic viscosity of 0.5 dL/g (the measured coating solution viscosity was 1.4 cps for this polymer in the above specified coating solvent at 1.16 wt. percent).

C-3 Cellulose acetate propionate (CAP) (identification CAP-504-0.2 (1% maximum acetyl, 40–45% propionyl) (Eastman Chemical products with an intrinsic viscosity of 0.4 dL/g (the measured coating solution viscosity was 1.4 cps for this polymer in the above specified coating solvent at 1.16 wt. percent).

C-4 Cellulose acetate butyrate (CAB) (identification CAB-381-20)(13% acetyl, 37% butyral) (Eastman Chemical Products) with an intrinsic viscosity of 1.3 dL/g (the measured coating solution viscosity was 2.8 cps for this polymer in the above specified coating solvent at 1.16 wt. percent).

C-5 Cellulose acetate butyrate (CAB) (identification CAB-381-2) (13% acetyl, 37% butyral) (Eastman Chemical Products) with an intrinsic viscosity of 0.8 dL/g (the measured coating solution viscosity was 1.7 cps for this polymer in the above specified coating solvent at 1.16 wt. percent).

C-6 Cellulose acetate (CA) (#04655 powder) (Eastman Chemical Products) with an intrinsic viscosity of 1.2 dL/g (the measured coating solution viscosity was 3.8 cps for this polymer in the above specified coating solvent at 1.16 wt. percent).

C-7 Cellulose acetate (CA) (#04650 crystals) (Eastman Chemical Products) with an intrinsic viscosity of 1.1 dL/g (the measured coating solution viscosity was 2.3 cps for this polymer in the above specified coating solvent at 1.16 wt. percent).

C-8 Cellulose acetate (CA) (#04644 powder) (Eastman Chemical Products) with an intrinsic viscosity of 0.8 dL/g (the measured coating solution viscosity was 1.8 cps for this polymer in the above specified coating solvent at 1.16 wt. percent).

C-9 Ethyl cellulose (EC) SP[2] #459 (Scientific Polymer Products) with an intrinsic viscosity of 0.2 dL/g (the measured coating solution viscosity was 1.2 cps for this polymer in the above specified coating solvent at 1.16 wt. percent).

After coating and drying, cut sheets (24 cm×19 cm) of each of the dye-donors were evaluated for coating uniformity by visual observation and transmission densitometry measurements. Donor uniformity was classified on a scale of one to five with "1" representing no visible density variations in the coating area as viewed by transmitted light, and "5" representing extreme and numerous density variations as viewed by transmitted light. A "2" value was assigned to coatings just barely showing density variations over a small area, while "3" and 4" represented progressive increasing defects. The same dye-donors were scanned in the coating direction in a linear manner using an X-Rite 310 Transmission Densitometer (X-Rite Co.,) equipped with a motorized film advance using a 1.0 mm aperture and a Status A green filter to give 512 individual density readings. From these reading an average density and standard deviation were calculated. The coefficient of variation (the standard deviation divided by the average density) was calculated as a measure of coating uniformity. The following results were obtained:

| Polymeric Binder | Intrinsic Viscosity | Density Uniformity | | Average Overall Density |
|---|---|---|---|---|
| | | Observed | Coeff. Variation | |
| 1 (CAP) | 1.8 | 2 | 0.010 | 2.3 |
| 2 (HPC) | >4.5 | 1 | 0.005 | 2.2 |
| 3 (EC) | >3.4 | 1 | 0.008 | 2.4 |
| 4 (EC) | 3.0 | 1 | 0.005 | 2.4 |
| 5 (EC) | 2.9 | 1 | 0.009 | 2.3 |
| C-1 (CAP) | 1.4 | 4 | 0.017 | 2.3 |
| C-2 (CAP) | 0.5 | 5 | 0.050 | 2.2 |
| C-3 (CAP) | 0.4 | 5 | 0.061 | 2.0 |
| C-4 (CAB) | 1.3 | 3 | 0.015 | 2.4 |
| C-5 (CAB) | 0.8 | 5 | 0.033 | 2.2 |
| C-6 (CA) | 1.2 | 3 | 0.016 | 1.1 |
| C-7 (CA) | 1.1 | 3 | 0.021 | 0.9 |
| C-8 (CA) | 0.8 | 5 | 0.030 | 0.8 |
| C-9 (EC) | 0.2 | 5 | 0.063 | 2.3 |

The observations tabulated above show that the coatings that used a polymeric binder with an intrinsic viscosity of 1.6 or more gave significantly better dye-donor coatings than those that used a binder of lower viscosity. The same correlation was observed for cellulose esters (polymer 1) or cellulose ethers (polymers 2 to 5).

The density values tabulated above correlate with the visual observations of the dye-donor of improved coating uniformity by use of high viscosity binders. Some of the control polymers, notably cellulose acetate, also had a very low overall average transmission density.

EXAMPLE 3

This example is similar to Example 2 in that dye donor elements were prepared using poly(vinyl alcohol-co-butyral) binders of differing intrinsic viscosities. A combination of cyan, magenta and yellow dyes was used to produce coatings that yield a black image when printed with an appropriate laser device. Transmission densities as scanned in the coating direction were used to demonstrate the uniformity of the coatings and the benefit of high inherent viscosity.

A dye donor element was prepared by coating on a 100 μm thick poly(ethylene terephthalate) support a dye layer with the magenta dye of Example 2 (0.22 g/m$^2$), the cyanine infrared absorbing dye of Example 2 (0.054 g/m$^2$), the phenyltricyanopropene cyan dye illustrated below (0.22 g/m$^2$), and the yellow dye illustrated below (0.22 g/m$^2$), in the binders identified below (0.65 g/m$^2$) from a solvent mixture of 50 wt % dichloromethane, 20 wt % 1,1,2-trichloroethane, 20 wt % toluene and 10 wt % ethanol.

Cyan Dye

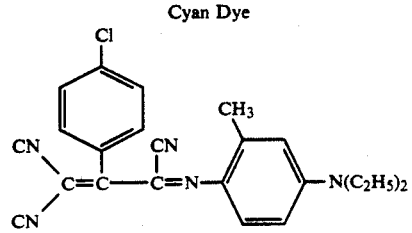

Yellow Dye

-continued

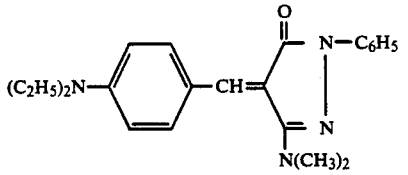

The solution viscosity was measured at 24° C. using a Brookfield viscometer as described in Example 2. Intrinsic viscosity measurements were also made as described in Example 2. The following invention polymeric binder was evaluated:

6. A (polyvinyl alcohol-co-butryal) (PVAB) Butvar B-72 ® (Monsanto Corp.) with an intrinsic viscosity of 1.9 dL/g (the measured coating solution viscosity was 20.4 cps in the above specified solvent at 2.77 wt percent.)

The following polymeric binders were evaluated as controls:

C-10 A polyvinyl alcohol-co-butryal) (PVAB) Butvar B-74 ® (Monsanto Corp.) with an intrinsic viscosity of 1.53 dL/g (the measured solution viscosity was 17 cps for this polymer in the above specified coating solvent at 2.77 wt percent).

C-11 A polyvinyl alcohol-co-butryal) (PVAB) Butvar B-73 ® (Monsanto Corp.) with an intrinsic viscosity of 1.41 dL/g (the measured solution viscosity was 13.4 cps in the above specified solvent system at 2.77 wt percent). This differs from polymer 10 in that the weight average molecular weight is 90–120,000 Daltons.

C-12 A polyvinyl alcohol-co-butryal) (PVAB) Butvar B-76 ® (Monsanto Corp.) with an intrinsic viscosity of 1.3 dL/g (the measured coating solution viscosity for the polymer in the above specified solvent system was 8.8 cps at 2.77 wt percent).

C-13 A polyvinyl alcohol-co-butryal) (PVAB) Butvar B-79 ® (Monsanto Corp.) with an intrinsic viscosity of 0.9 dL/g (the measured solution viscosity for this polymer was 5.2 cps at 2.77 wt percent).

After coating and drying, cut sheets (24 cm×19 cm) were evaluated for coating uniformity by visual inspection and by the scanning transmission densitometer described in Example 2. These values are tabulated below.

| Polymeric Binder | Intrinsic Viscosity | Density Uniformity Observed | Density Uniformity Coeff. Variation | Average Overall Density |
|---|---|---|---|---|
| 6 (PVAB) | 1.9 | 1 | 0.003 | 2.9 |
| C-10 (PVAB) | 1.5 | 2 | 0.004 | 2.9 |
| C-11 (PVAB) | 1.4 | 2 | 0.004 | 2.8 |
| C-12 (PVAB) | 1.3 | 3 | 0.007 | 2.8 |
| C-13 (PVAB) | 0.9 | 5 | 0.016 | 2.8 |

The observations tabulated above show that the coating that used a poly(vinyl alcohol-co-butyral) binder with an intrinsic viscosity of 1.6 or more gave significantly better dye-donor coatings than those that used a binder of lower viscosity.

The density values tabulated above correlate with the visual observations of the dye-donor of improved coating uniformity by use of high viscosity binders.

EXAMPLE 4

This example is similar to Example 2 but uses the dye-donors of that example to print by laser thermal dye-transfer onto receivers in order to demonstrate that the non-uniformities observed in the dye-donor affect print quality.

Dye-donor elements involving polymeric binders of different intrinsic viscosity were prepared as described in Example 2.

Intermediate receivers were prepared as follows:

A layer of metallic aluminum was vacuum deposited using an aluminum source and electron beam vapor deposition to a coverage of 0.180 μm on a poly(ethylene terephthalate) support (100 μm thick). On this aluminized support was coated a layer containing a polyester derived from terephthalic acid, ethylene glycol, and 4,4'-bis(2-hydroxyethyl)bisphenol A (1:1 molar ratio of glycols) (7.2 g/m$^2$), polycaprolactone (Tone P-300 ® 0.30 g/m$^2$) and a silicone surfactant (DC-510 ®, Dow Corning Co., 0.01 g/m$^2$) from a dichloromethane solution. On top of this release layer, a dye-receiving layer of crosslinked poly(styrene-co-divinyl benzene) beads (12 micron average diameter) (0.09 g/m$^2$) and FC-431 ® surfactant (0.04 g/m$^2$) in a Butvar B-76 ® (poly(vinyl alcohol-co-butyral) binder (Monsanto Co.) 4.0 g/m$^2$) was coated from ethanol.

A second or final receiving element was prepared on a paper stock representing the substrate used for a printed ink image such as might be obtained from a printing press. A layer of poly(styrene-co-divinylbenzene) beads (14 micron average diameter) (0.11 g/m$^2$) and 510 Silicone Fluid ® (Dow Corning Co.) (0.03 g/m$^2$) in a Butvar B-76 ® (poly(vinyl alcohol-co-butyral) binder (Monsanto Corp) (4.0 g/m$^2$) was coated on a poly(ethylene terephthalate) support (100 μm thick) from dichloromethane. The dye-receiving layer was then heat laminated to Textweb (Seneca Paper Co.) 60 pound paper stock by a single passage through a set of heated moving rollers at 120° C. (polymer coated side of intermediate receiver in contact with paper stock). The poly(ethylene terephthalate) support was peeled off and discarded leaving a dye-migration barrier overlayer of poly(vinyl alcohol-co-butyral) on one side of the paper stock.

Dye images were printed over an area of approximately 22 cm×45 cm using the intermediate dye-receiver and the dye-donors. A laser imaging device as described in U.S. Pat. No. 4,876,235 was used consisting of a series of diode lasers connected to a lens assembly mounted on a translation stage and focused onto the dye-donor layers.

The intermediate dye-receiving element was secured to the drum of the diode laser imaging device with the receiving layer facing out. The dye-donor element was secured in face-to-face contact with the receiving element.

The diode lasers used were Spectra Diode Labs No. SDL-2430, each having an integral, attached optical fiber for the output of the laser beam with a wavelength range 800-830 nm and a nominal power output of 250 milliwatts at the end of the optical fiber. The cleaved face of the optical fiber (100 microns core diameter) was imaged onto the plane of the dye-donor with a 0.5 magnification lens assembly mounted on a translation stage giving a nominal spot size of 27 microns and a measured total power at the focal plane of 171 milliwatts.

The drum, 168 mm in circumference, was rotated at 500 rpm and the imaging electronics were activated. The translation stage was incrementally advanced across the dye-donor by means of a lead screw turned by a microstepping motor, to give a center-to-center line distance of 14 microns (714 lines per centimeter, or 1800 lines per inch). The full laser power was modulated for each donor to provide an image of Status A green density at approximately 1.4.

After the laser had scanned the complete image, the laser exposing device was stopped and the intermediate receiver was separated from the dye donor. The intermediate receiver containing a dye image was laminated to the final receiving layer prepared above by passage through a pair of rubber rollers heated to 120° C. The polyethylene terephthalate support was then peeled away leaving the dye image and poly(vinyl alcohol-co-butyral) firmly adhered to the paper.

Each resulting image obtained by laser printing was evaluated for uniformity by reading a 15 cm×22 cm area on Model MTI Mottle Tester (Tobias Associates, Inc.). The mottle index as obtained is tabulated below. Larger numbers indicate more non-uniformity of density. A visual evaluation of uniformity was also made and classified as:

Very good—no significant density variations
Good—few or isolated minor density variations
Poor—numerous or relatively large area of density variation over some portion of print
Very Poor—substantial or very large areas of density variation over large portion of print.

The following results were obtained:

| Polymeric Binder | PRINT UNIFORMITY | |
|---|---|---|
| | Visual | Mottle Index |
| 1 (CAP) | Good | 542 |
| 2 (HPC) | Very Good | 543 |
| 3 (EC) | Very Good | 551 |
| 4 (EC) | Very Good | 496 |
| 5 (EC) | Very Good | 527 |
| C-1 (CAP) | Poor | 745 |
| C-2 (CAP) | Very Poor | 1456 |
| C-3 (CAP) | Very Poor | 1836 |
| C-4 (CAB) | Very Poor | 801 |
| C-5 (CAB) | Very Poor | 1019 |
| C-6 (CA) | Poor | 739 |
| C-7 (CA) | Poor | 653 |
| C-8 (CA) | Very Poor | 941 |
| C-9 (EC) | Very Poor | 2475 |

The above evaluations correlate well with those for the donor variations of Example 2 and illustrate that binders of high intrinsic viscosity provide improved density uniformity.

EXAMPLE 6

A dye donor element was prepared by first coating on both sides of a 6 μm thick poly(ethylene terephthalate) support (DuPont Mylar® 24C) a subbing layer of titanium tetra-n-butyl alkoxide, 0.11 g/m$^2$ from a solvent system of 85 wt % n-propyl acetate and 15 wt % n-butanol.

On one side of this support was coated a slipping layer consisting primarily of polytetra-fluoroethylene particles dispersed in a binder (Emralon 329®, Acheson Colloides Co, Port Huron, Michigan), at 0.54 g/m$^2$ from a solvent system consisting of 65 wt % n-propyl acetate, 23 wt % toluene, 3 wt % isopropanol and 8 wt % n-butanol. On the other side of the support was coated a dye and binder solution consisting of the cyan, magenta and yellow dyes of Example 3 at 0.22 g/m$^2$ each, with the indicated binder below, from a solvent system of 70 wt % methyl isobutylketone and 30% ethanol. Viscosity measurements of the coating solutions were made as described in Example 2.

The polymeric binders evaluated were invention binder #1 of Example 2, and control binders C-1 and C-2 of Example 2.

A dye receiving element was prepared as described in U.S. Pat. No.4,927,803 by coating sequentially on a polyethylene resin coated paper a subbing layer of an aminosilane (Dow Corning Z-6020®, 0.11 g/m$^2$), from an ethanol solution containing 1% water, a layer containing a bisphenol-A polycarbonate (Makrolon M5700® Mobay Inc, 1.61 g/m$^2$), a bisphenol-A polycarbonate modified with 50 mole % 3-oxa-1,5-pentanediol, (1.61 g/m$^2$), dioctyl phthalate (0.32 g/m$^2$) and diphenyl phthalate (0.32 g/m$^2$) from dichloromethane, followed by a layer containing the same bisphenol-A polycarbonate modified with 50 mole % 3-oxa-1,5-pentanediol (0.22 g/m$^2$), a silicone surfactant (Dow Corning DC-510®, (0.016 g/m$^2$) and a fluorocarbon surfactant (Dow Chemical Co, FC-431,® 0.016 g/m$^2$) also from a dichloromethane solution.

The dye donor coatings were evaluated for uniformity visually and by measuring the visual transmission density with the scanning densitometer described in Example 2.

Prints were also made with the dye donors and receiver described above. The dye side of the dye-donor element approximately 10 cm×14 cm in area was placed in contact with the polymeric receiving layer side of the dye-receiver element of the same area. The assemblage was fastened to the top of a motor-driven 53 mm diameter rubber roller and a TDK Thermal Head L-231 (137 DPI), thermostatted at 26° C., was pressed with a force of 34 Newtons against the dye-donor element side of the assemblage pushing it against the rubber roller.

The imaging electronics were activated and the assemblage was drawn between the printing head and roller at 13.6 mm/sec. Coincidentally, the resistive elements in the thermal print head were pulsed at 131 μsec intervals (127 μsec/pulse) during the 17 μsec/line printing time. The voltage supplied to the print head was approximately 13v resulting in an instantaneous peak power of approximately 0.32 watts/dot and a maximum total energy of about 2 mJoules/dot.

A low density, approximately 1.0 status A visual density, uniform field was printed. A 100×48 cm area of the prints was measured for uniformity with the Tobias Associates MT1 Mottle Meter described in Example 2. The following results were obtained:

| Binder | Inherent Visc. | Donor Trans. Density | Coeff. of Variation of Donor | Mottle of Print |
|---|---|---|---|---|
| 1 (CAP) | 1.8 | 2.2 | 0.007 | 189 |
| C-1 (CAP) | 1.3 | 2.2 | 0.009 | 202 |
| C-2 (CAP) | 0.5 | 2.2 | 0.041 | 294 |

The results tabulated above indicate that high inherent viscosity binders yield dye donors that are improved in uniformity, which in turn, yield prints that are more uniform.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer comprising a dye dispersed in a polymeric binder, the improvement wherein the polymeric binder has an intrinsic viscosity of at least 1.6.

2. The element of claim 1 wherein said polymeric binder is a cellulosic material.

3. The element of claim 2 wherein said cellulosic material is cellulose acetate propionate.

4. The element of claim 2 wherein said cellulosic material is a hydroxypropyl cellulose ether.

5. The element of claim 2 wherein said cellulosic material is an ethyl cellulose ether.

6. The element of claim 1 wherein said polymeric binder is poly(vinyl alcohol-co-acetal).

7. The element of claim 6 wherein said poly(vinyl alcohol-co-acetal is poly(vinyl alcohol-co-butyral).

8. The element of claim 1 wherein said dye-donor has a slipping layer coated on the back side thereof.

9. The element of claim 1 wherein said dye layer has an infrared-absorbing material associated therewith.

10. In a process of forming a thermal dye transfer image comprising:

a) contacting at least one dye-donor element comprising a support having thereon a dye layer comprising a dye dispersed in a polymeric binder with a dye-receiving element comprising a support having thereon a polymeric dye image-receiving layer, b) imagewise-heating said dye-donor element; and c) transferring a dye image to said dye-receiving element to form said thermal dye transfer image, the improvement wherein said polymeric binder has an intrinsic viscosity of at least 1.6.

11. The process of claim 10 wherein said polymeric binder is a cellulosic material.

12. The process of claim 11 wherein said cellulosic material is cellulose acetate propionate.

13. The process of claim 11 wherein said cellulosic material is a hydroxypropyl cellulose ether.

14. The process of claim 11 wherein said cellulosic material is an ethyl cellulose ether.

15. The process of claim 10 wherein said polymeric binder is poly(vinyl alcohol-co-acetal).

16. The process of claim 15 wherein said poly(vinyl alcohol-co-acetal is poly(vinyl alcohol-co-butyral).

17. The process of claim 10 wherein said dye-donor has a slipping layer coated on the back side thereof.

18. The process of claim 10 wherein said dye layer has an infrared-absorbing material associated therewith.

19. The process of claim 10 wherein said said heating step is performed by a laser.

20. In a thermal dye transfer assemblage comprising:

a) a dye-donor element comprising a support having thereon a dye layer comprising a dye dispersed in a polymeric binder, and b) a dye-receiving element comprising a support having thereon a dye image-receiving layer, said dye-receiving element being in a superposed relationship with said dye-donor element so that said dye layer is in contact with said dye image-receiving layer, the improvement wherein said polymeric binder has an intrinsic viscosity of at least 1.6.

* * * * *